US011220802B2

(12) United States Patent
Izumikawa

(10) Patent No.: US 11,220,802 B2
(45) Date of Patent: Jan. 11, 2022

(54) SHOVEL, SHOVEL MANAGEMENT APPARATUS, AND SHOVEL MANAGEMENT ASSISTING DEVICE

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 15 days.

(21) Appl. No.: 16/662,356

(22) Filed: Oct. 24, 2019

(65) Prior Publication Data

US 2020/0056346 A1 Feb. 20, 2020

Related U.S. Application Data

(63) Continuation of application No. PCT/JP2018/016760, filed on Apr. 25, 2018.

(30) Foreign Application Priority Data

Apr. 26, 2017 (JP) ..... JP2017-087375

(51) Int. Cl.
*E02F 9/20* (2006.01)

(52) U.S. Cl.
CPC ..... *E02F 9/2025* (2013.01)

(58) Field of Classification Search
CPC ..... E02F 9/20; E02F 9/2025; E02F 9/267; G07C 3/02; G07C 5/08
See application file for complete search history.

(56) References Cited

U.S. PATENT DOCUMENTS 6,851,207 B2 * 2/2005 Yoshimatsu ..... E02F 9/2075 37/348
6,985,804 B2 * 1/2006 Minami ..... F16H 61/0213 340/439
7,483,814 B2 * 1/2009 Hoshi ..... E02F 9/26 702/182
7,588,118 B2 * 9/2009 Sawada ..... E02F 9/2235 180/242

(Continued)

FOREIGN PATENT DOCUMENTS

EP 2876220 5/2015
JP 2613456 5/1997

(Continued)

OTHER PUBLICATIONS

International Search Report for PCT/JP2018/016760 dated Jul. 31, 2018.

*Primary Examiner* — Tyler J Lee
(74) *Attorney, Agent, or Firm* — IPUSA, PLLC

(57) ABSTRACT

A shovel management apparatus configured to manage a shovel including a lower traveling body, an upper turning body mounted on the lower traveling body via a turning mechanism, and an excavation attachment attached to the upper turning body includes a memory and a processor coupled to the memory. The processor is configured to obtain fuel consumption information regarding the fuel consumption of the shovel and work mode information indicating the work mode of the shovel set by an operator and aggregate the fuel consumption information according to the work mode.

15 Claims, 12 Drawing Sheets

(56) References Cited

U.S. PATENT DOCUMENTS

| | | | | |
|---|---|---|---|---|
| 8,959,893 | B2 * | 2/2015 | Tajima | F02D 41/027 60/285 |
| 9,026,317 | B2 * | 5/2015 | Furukawa | E02F 9/26 701/50 |
| 9,340,957 | B2 * | 5/2016 | Magaki | E02F 9/26 |
| 9,464,409 | B2 * | 10/2016 | Magaki | E02F 9/26 |
| 9,481,981 | B2 * | 11/2016 | Magaki | E02F 9/26 |
| 9,637,891 | B2 * | 5/2017 | Adachi | G07C 5/008 |
| 2002/0045986 | A1 * | 4/2002 | Tamaru | E02F 9/24 701/482 |
| 2003/0114966 | A1 * | 6/2003 | Ferguson | G06F 11/2294 701/31.4 |
| 2006/0229786 | A1 * | 10/2006 | Sawada | E02F 9/2235 701/50 |
| 2006/0287841 | A1 | 12/2006 | Hoshi et al. | |
| 2010/0191404 | A1 * | 7/2010 | Ishikawa | B60K 35/00 701/31.4 |
| 2012/0330500 | A1 | 12/2012 | Kamada et al. | |
| 2013/0239558 | A1 * | 9/2013 | Shirao | E02F 9/2253 60/327 |
| 2015/0233278 | A1 * | 8/2015 | Shimazu | F01N 3/18 60/277 |
| 2015/0246613 | A1 * | 9/2015 | Shimazu | G07C 5/0808 701/102 |
| 2015/0354171 | A1 * | 12/2015 | Sakamoto | B60W 20/11 180/65.26 |
| 2016/0017574 | A1 * | 1/2016 | Adachi | E02F 9/267 701/31.4 |
| 2017/0009634 | A1 * | 1/2017 | Shiomi | F02D 41/025 |

FOREIGN PATENT DOCUMENTS

| | | |
|---|---|---|
| JP | 2008-202221 | 9/2008 |
| JP | 2008-240361 | 10/2008 |
| JP | 2014-112329 | 6/2014 |
| JP | 2015-018343 | 1/2015 |
| JP | 2015-183438 | 10/2015 |
| WO | 2015/114909 | 8/2015 |

* cited by examiner

FIG.6

| TIME | BODY POSITION | ORIENTATION | POSTURE | FUEL INJECTION AMOUNT | LOAD FACTOR | WORK MODE | WORK TYPE | SOIL AMOUNT |
|---|---|---|---|---|---|---|---|---|
| 10:00:00 | 36° 00' 00"N 140° 00' 00"E | 90° | 40° | 0.3 mL | 30% | H | EXCAVATION | 0 |
| 10:00:01 | 36° 00' 00"N 140° 00' 00"E | 90° | 40° | 0.2 mL | 30% | H | EXCAVATION | 0 |
| 10:00:02 | 36° 00' 00"N 140° 00' 00"E | 90° | 40° | 0.3 mL | 30% | H | EXCAVATION | 0 |
| ... | ... | ... | ... | ... | ... | ... | ... | ... |

27

| DATE | WORK MODE | A | | | | H | | | | SP | | | |
|---|---|---|---|---|---|---|---|---|---|---|---|---|---|
| 2016/7/20 | LOAD FACTOR (%) | ~25 | ~50 | ~75 | ~100 | ~25 | ~50 | ~75 | ~100 | ~25 | ~50 | ~75 | ~100 |
| | CUMULATIVE TIME (h) | 0.3 | 0.8 | 0.6 | 0.3 | 0.6 | 1.1 | 0.9 | 0.4 | 0.4 | 0.9 | 0.5 | 0.2 |
| | FUEL INJECTION AMOUNT (L) | 1.2 | 4.0 | 3.6 | 2.1 | 3.0 | 6.6 | 6.3 | 3.2 | 2.4 | 6.3 | 4.0 | 1.8 |
| | SOIL AMOUNT ($m^3$) | 150 | | | | 180 | | | | 160 | | | |

FIG.7

27

| DATE | WORK MODE | A | | | | H | | | | SP | | | |
|---|---|---|---|---|---|---|---|---|---|---|---|---|---|
| 2016/7/20 | WORK TYPE | IDLING | TRAVELING | EXCAVATION | GROUND LEVELING | IDLING | TRAVELING | EXCAVATION | GROUND LEVELING | IDLING | TRAVELING | EXCAVATION | GROUND LEVELING |
| | CUMULATIVE TIME (h) | 2.1 | 0.8 | 0.7 | 0.0 | 0.7 | 0.2 | 2.1 | 0.0 | 0.5 | 0.0 | 1.2 | 0.0 |
| | FUEL INJECTION AMOUNT (L) | 4.2 | 3.2 | 3.5 | 0.0 | 3.2 | 1.2 | 14.7 | 0.0 | 3.7 | 0.0 | 10.8 | 0.0 |
| | SOIL AMOUNT ($m^3$) | 150 | | | | 180 | | | | 160 | | | |

FIG.8

27

| DATE | WORK MODE | A | | | | H | | | | SP | | | |
|---|---|---|---|---|---|---|---|---|---|---|---|---|---|
| 2016/7/20 | LOAD FACTOR (%) | ~25 | ~50 | ~75 | ~100 | ~25 | ~50 | ~75 | ~100 | ~25 | ~50 | ~75 | ~100 |
| | CUMULATIVE TIME (h) | 0.1 | 0.3 | 0.4 | 1.2 | 0.6 | 1.1 | 0.9 | 0.4 | 0.4 | 0.9 | 0.5 | 0.2 |
| | FUEL INJECTION AMOUNT (L) | xxx | xxx | xxx | xxx | xxx | xxx | xxx | xxx | xxx | xxx | xxx | xxx |
| | SOIL AMOUNT ($m^3$) | 150 | | | | 180 | | | | 160 | | | |

RECOMMENDED WORK MODE
H

SUPPOSED FUEL CONSUMPTION AMOUNT xxxL

FIG.9

27

| DATE | WORK MODE | A | | | | H | | | | SP | | | |
|---|---|---|---|---|---|---|---|---|---|---|---|---|---|
| 2016/7/20 | LOAD FACTOR (%) | ~25 | ~50 | ~75 | ~100 | ~25 | ~50 | ~75 | ~100 | ~25 | ~50 | ~75 | ~100 |
| | CUMULATIVE TIME (h) | 0.3 | 0.8 | 0.6 | 0.3 | 0.6 | 1.1 | 0.9 | 0.4 | 1.3 | 0.3 | 0.2 | 0.2 |
| | FUEL INJECTION AMOUNT (L) | xxx | xxx | xxx | xxx | xxx | xxx | xxx | xxx | xxx | xxx | xxx | xxx |
| | SOIL AMOUNT ($m^3$) | 150 | | | | 180 | | | | 160 | | | |

RECOMMENDED WORK MODE
H

SUPPOSED FUEL CONSUMPTION AMOUNT xxxL

FIG.10

27

| DATE | WORK MODE | A | | | | H | | | | SP | | | |
|---|---|---|---|---|---|---|---|---|---|---|---|---|---|
| 2016/7/20 | WORK TYPE | IDLING | TRAVELING | EXCAVATION | GROUND LEVELING | IDLING | TRAVELING | EXCAVATION | GROUND LEVELING | IDLING | TRAVELING | EXCAVATION | GROUND LEVELING |
| | CUMULATIVE TIME (h) | 2.1 | 0.8 | 0.7 | 0.0 | 0.7 | 0.2 | 2.1 | 0.0 | 0.5 | 0.0 | 0.0 | 1.2 |
| | FUEL INJECTION AMOUNT (L) | xxx | xxx | xxx | xxx | xxx | xxx | xxx | xxx | xxx | xxx | xxx | xxx |
| | SOIL AMOUNT ($m^3$) | 150 | | | | 180 | | | | 160 | | | |

RECOMMENDED WORK MODE H

FIG.11

SHOVEL, SHOVEL MANAGEMENT APPARATUS, AND SHOVEL MANAGEMENT ASSISTING DEVICE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/016760, filed on Apr. 25, 2018 and designating the U.S., which claims priority to Japanese patent application No. 2017-087375, filed on Apr. 26, 2017. The entire contents of the foregoing applications are incorporated herein by reference.

BACKGROUND

Technical Field

The present invention relates to shovels, shovel management apparatuses, and shovel management assisting devices.

Description of Related Art

A device to record the amount of fuel consumption of a construction machine has been known. This device determines whether the type of work is excavation work or loading work and records the amount of fuel consumption work type by work type. Specifically, this device determines that it is excavation work when the ratio of work-only operating time to work time is more than a threshold, and determines that it is loading work when the ratio is less than or equal to the threshold. The work time is time obtained by subtracting non-operating time and travel-only operating time from the operating time of an engine. The non-operating time is time during which no operating signal is input from an operating apparatus while the engine is in operation. The travel-only operating time is time during which only an operating signal to a traveling apparatus is input while the engine is in operation. The work-only operating time is time during which only an operating signal to a work apparatus is input while the engine is in operation. This device determines that the engine is in operation when the actual rotational speed of the engine is more than or equal to a threshold and determines that the engine is stopped when the actual rotational speed of the engine is less than the threshold, but does not compute the amount of fuel consumption according to the set rotational speed of the engine.

SUMMARY

A shovel management apparatus configured to manage a shovel including a lower traveling body, an upper turning body mounted on the lower traveling body via a turning mechanism, and an excavation attachment attached to the upper turning body includes a memory and a processor coupled to the memory. The processor is configured to obtain fuel consumption information regarding the fuel consumption of the shovel and work mode information indicating the work mode of the shovel set by an operator and aggregate the fuel consumption information according to the work mode.

BRIEF DESCRIPTION OF THE DRAWINGS

FIG. 6 is a diagram illustrating an example of history information;

FIG. 7 is a diagram illustrating an example of aggregate results;

FIG. 8 is a diagram illustrating an example of the aggregate results;

FIG. 9 is a diagram illustrating an example of the aggregate results;

FIG. 10 is a diagram illustrating an example of the aggregate results;

FIG. 11 is a diagram illustrating an example of the aggregate results; and

DETAILED DESCRIPTION

The amount of fuel consumption, however, varies greatly according to the setting of the engine rotational speed even when the work type is the same. Therefore, accurate fuel consumption information cannot be obtained by recording the amount of fuel consumption according to work type without considering a difference in engine rotational speed.

For example, during excavation work, light-load work may be performed with the engine rotational speed being set relatively high or heavy-load work may be performed with the engine rotational speed being set relatively low. In either case, the imbalance between the set engine rotational speed and the load size deteriorates fuel consumption. It is impossible to be aware of the occurrence of such a situation with the configuration of computing the amount of fuel consumption according to work type.

Accordingly, it is desirable to provide a shovel management apparatus that more accurately obtains information on fuel consumption.

According to an aspect of the present invention, a shovel management apparatus that more accurately obtains information on fuel consumption can be provided.

An embodiment of the present invention is described below with reference to the drawings.

Figure 1:
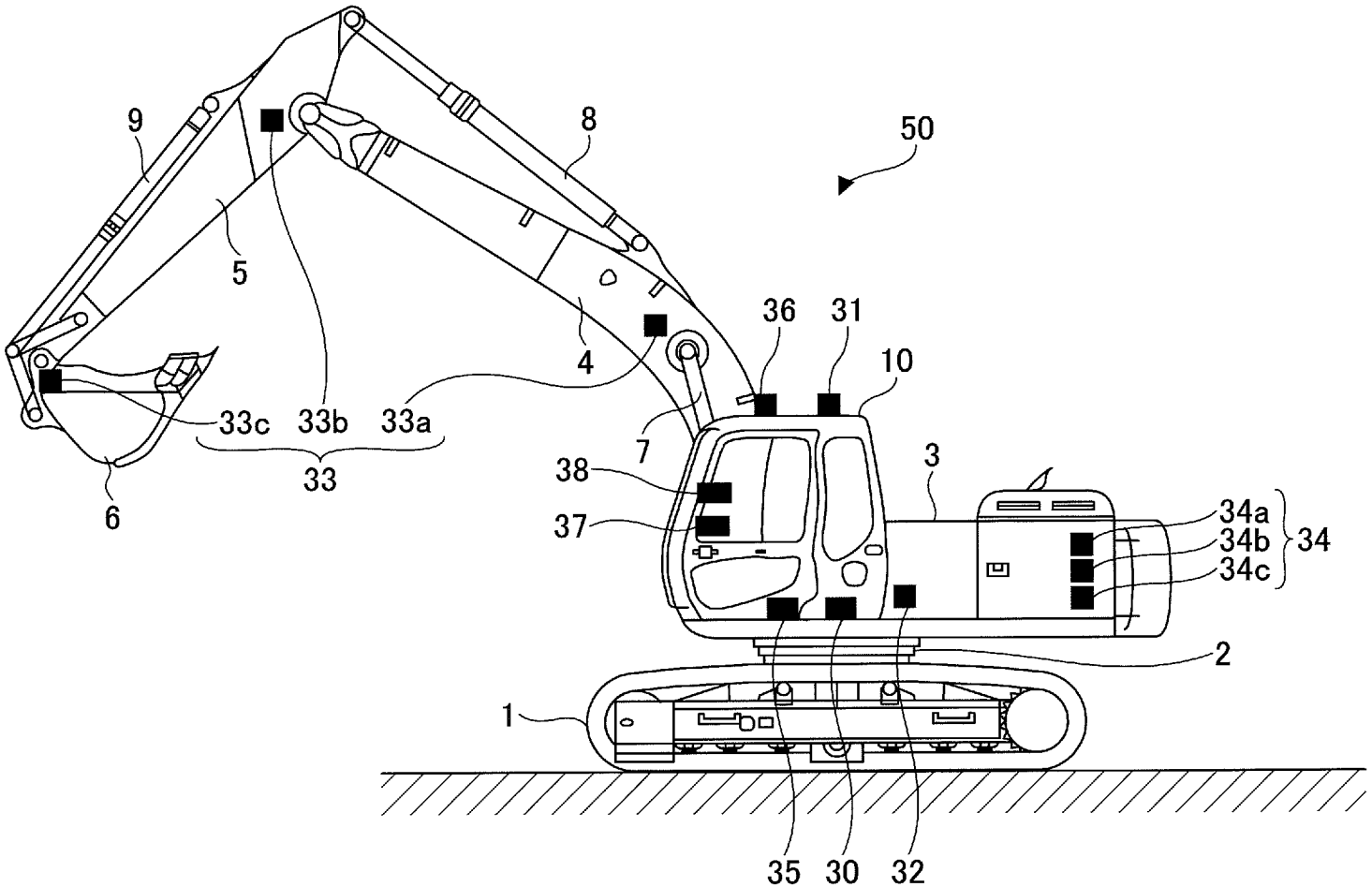
FIG. 1 is a schematic side view illustrating an example configuration of a shovel according to an embodiment of the present invention.

FIG. 1 is a schematic side view illustrating an example configuration of a shovel (excavator) 50 as a construction machine to which the present invention is applied. On a lower traveling body 1 of the shovel 50, an upper turning body 3 is mounted via a turning mechanism 2. A boom 4 is attached to the upper turning body 3, an arm 5 is attached to the end of the boom 4, and a bucket 6 is attached to the end of the arm 5. The boom 4, the arm 5, and the bucket 6 constitute an excavation attachment and are hydraulically driven by a boom cylinder 7, an arm cylinder 8, and a bucket cylinder 9, respectively. A cabin 10 is provided and a power source such as an engine is mounted on the upper turning body 3. An orientation information obtaining device 32 to obtain orientation information regarding the orientation of the shovel 50 and an operating condition information obtaining device 34 to obtain operating condition information regarding the operating condition of the shovel 50 are mounted on the upper turning body 3. A control device 30, a storage device 35, a display device 37, and a work mode information obtaining device 38 are installed inside the cabin 10. A body position information obtaining device 31 and a communications device 36 are mounted on a ceiling part of the cabin 10. A posture information obtaining device 33 to obtain posture information regarding the posture of the excavation attachment is mounted on the excavation attachment.

Figure 2:
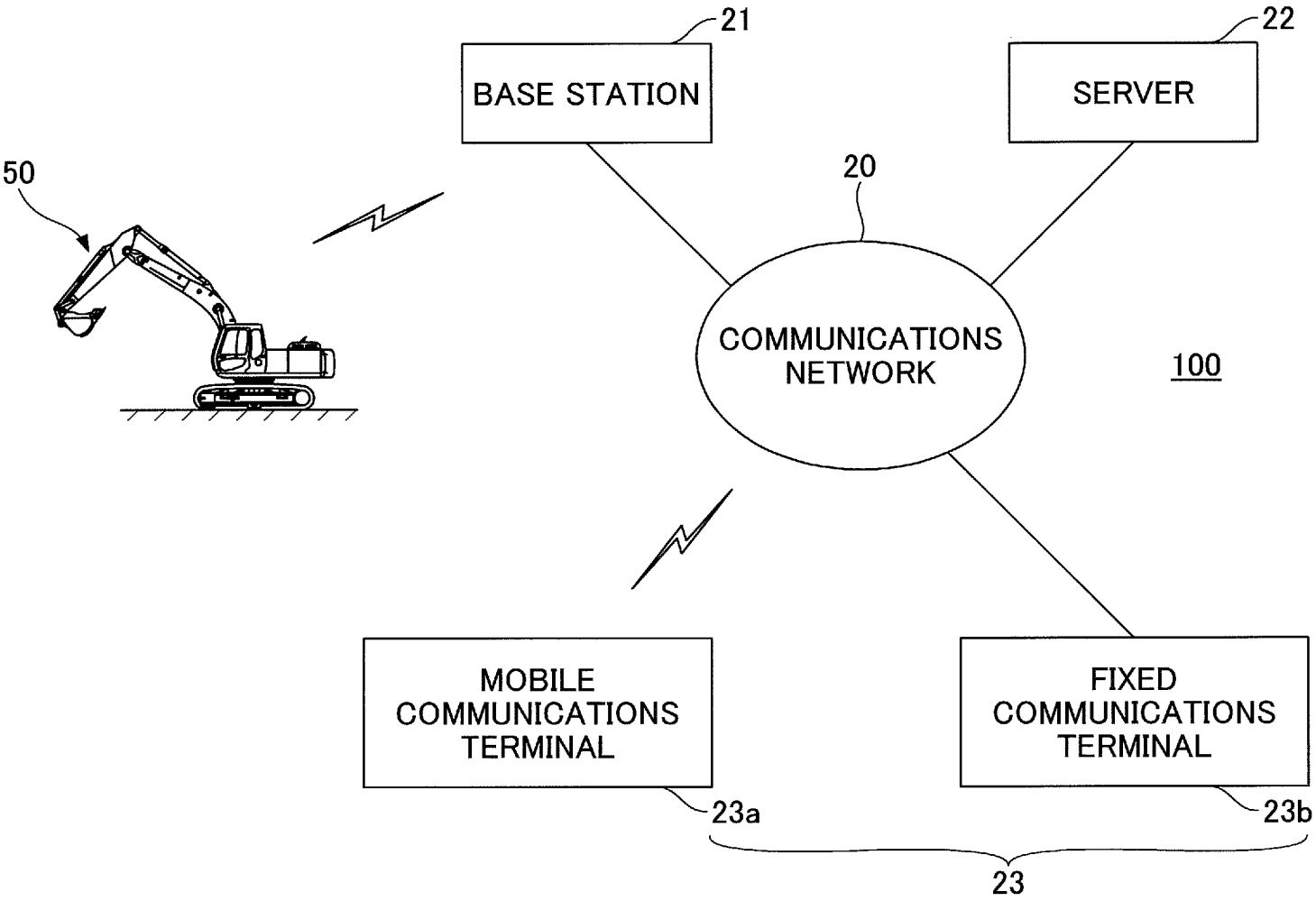
FIG. 2 is a schematic diagram illustrating an example configuration of a management system according to the embodiment of the present invention.

FIG. 2 is a schematic diagram illustrating an example configuration of a management system 100 according to the embodiment of the present invention. The management system 100 is composed mainly of the shovel 50, a base station 21, a server 22, and a communications terminal 23. The communications terminal 23 includes a mobile communications terminal 23*a*, a fixed communications terminal 23*b*, etc. The base station 21, the server 22, and the communications terminal 23 are interconnected through a communications network 20 such as the Internet. Each of the shovel 50, the base station 21, the server 22, and the communications terminal 23 may be one or more in number.

The base station 21 is a fixed facility to receive information transmitted by the shovel 50, and transmits information to and receives information from the shovel 50 through satellite communications, mobile phone communications, short-range wireless communications, or the like.

The server 22 is an example of a shovel management apparatus to store and manage information transmitted by the shovel 50, and is, for example, a computer including a CPU, a ROM, a RAM, an input/output interface, etc. Specifically, the server 22 obtains, through the communications network 20, and stores information received by the base station 21, and manages the information so that an operator (manager) can refer to the stored information on an as-needed basis. The shovel management apparatus may be composed of multiple servers 22. According to this embodiment, the shovel management apparatus is composed of five servers 22 installed at five different locations.

The communications terminal 23 is an example of a shovel management assisting device to assist the management of the shovel 50 by providing the operator (manager) with information stored in the server 22, and is, for example, a computer including a CPU, a ROM, a RAM, an input/output interface, an input device, a display, etc. Specifically, the communications terminal 23 accesses the server 22 through the communications network 20 to enable the operator (manager) to view information on the shovel 50.

Figure 3:
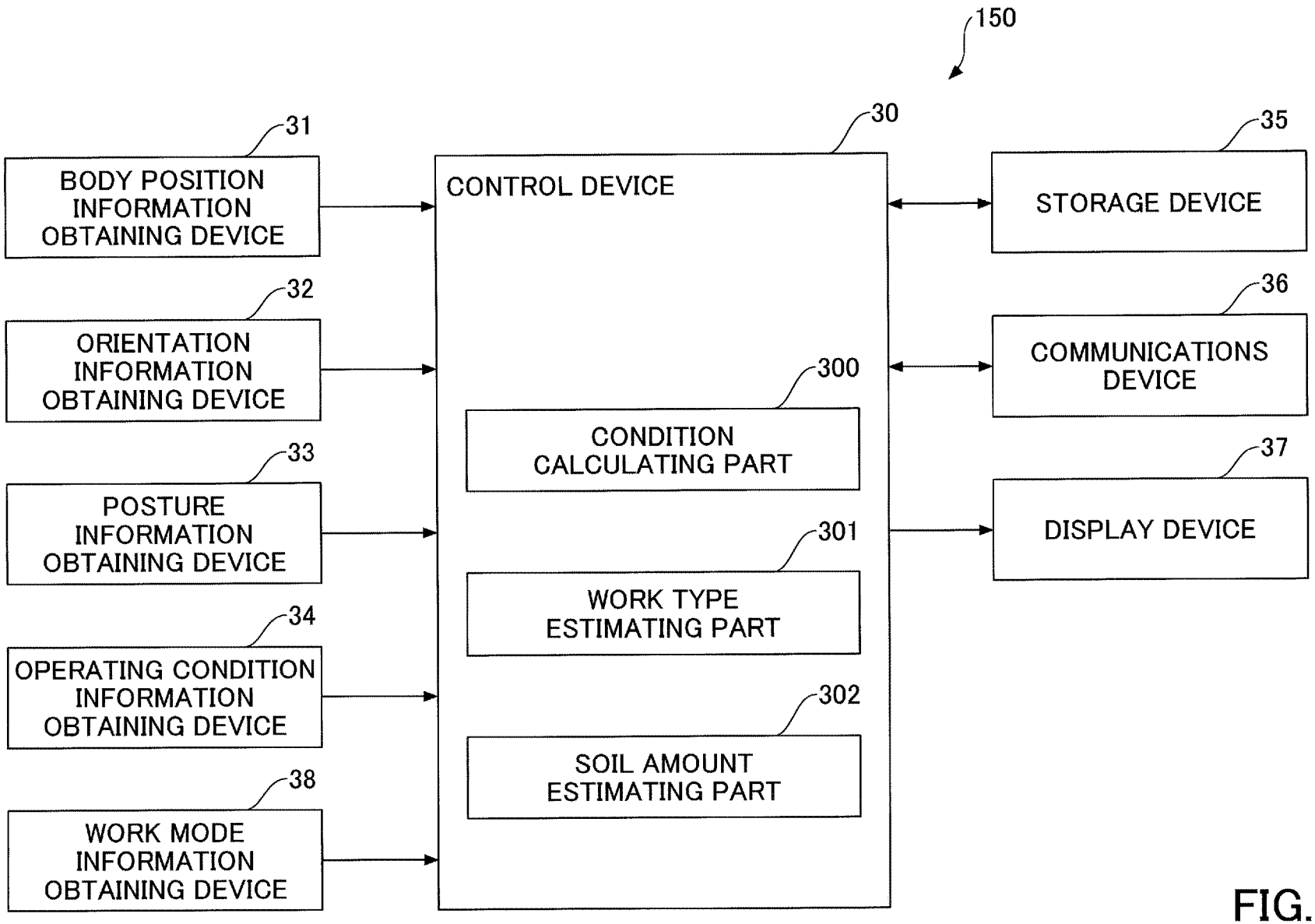
FIG. 3 is a functional block diagram illustrating an example configuration of a management apparatus installed in the shovel of FIG. 1.

FIG. 3 is a schematic diagram illustrating an example configuration of a management device 150 installed in the shovel 50 according to the embodiment of the present invention. The management device 150 is composed mainly of the control device 30, the body position information obtaining device 31, the orientation information obtaining device 32, the posture information obtaining device 33, the operating condition information obtaining device 34, the storage device 35, the communications device 36, the display device 37, and the work mode information obtaining device 38.

The control device 30 is a device to control the operation of the management device 150, and is, for example, a computer including a CPU, a RAM, a ROM, etc. Specifically, the control device 30 reads programs corresponding to the functional elements of a condition calculating part 300, a work type estimating part 301, and a workload estimating part 302 from the ROM, loads the programs into the RAM, and causes the CPU to execute processes corresponding to the functional elements. The control device 30 stores information obtained by the functional elements in the RAM.

Information is input from the body position information obtaining device 31, the orientation information obtaining device 32, the posture information obtaining device 33, the operating condition information obtaining device 34, and the work mode information obtaining device 38 to the control device 30. The control device 30 stores the input information and the obtaining time (input time) of the information in correlation with each other in the RAM. Thereafter, the control device 30 controls the communications device 36 to transmit the information stored in the RAM to the server 22. As a result, the information input to the control device 30 and information generated based on the information are transmitted to the server 22. The control device 30 may transmit the information stored in the RAM at predetermined time intervals (for example, every minute or every hour), at a predetermined time, or at a predetermined timing (for example, when the engine stops or when the below-described work mode is changed). The control device 30 may store the above-described information in the storage device 35.

The body position information obtaining device 31 obtains body position information regarding the position of the construction machine body. According to this embodiment, the body position information obtaining device 31 is a GPS (Global Positioning System) device to receive the output signal of a GPS satellite at a GPS receiver via a GPS antenna and measure and calculate body position information (for example, latitude, longitude, and altitude). Specifically, the body position information obtaining device 31 is mounted on the ceiling part of the cabin 10 to obtain the body position information corresponding to the reference position (for example, turning center) of the shovel 50 and output the obtained body position information to the control device 30.

The orientation information obtaining device 32 obtains orientation information regarding the orientation of the construction machine. According to this embodiment, the orientation information obtaining device 32 is a geomagnetic sensor to obtain the orientation (azimuth) of the shovel 50 with the excavation attachment side being the front side, and outputs the detected orientation information to the control device 30.

The orientation information obtaining device 32 may be another GPS device mounted at a position different from the installation position of the GPS device serving as the body position information obtaining device 31 on the shovel 50. This is because the orientation of the shovel 50 can be specified based on position information obtained by each of the two GPS devices.

The orientation information obtaining device 32 may have a function to obtain the inclination of the construction machine relative to a horizontal plane in the direction of extension of the excavation attachment. Specifically, the orientation information obtaining device 32 may obtain not only the two-dimensional orientation information of the shovel 50 but also the three-dimensional information of the shovel 50 including the inclination of the shovel 50 relative to a horizontal plane (hereinafter, "inclination information"), additionally using the output of a tilt sensor to measure the inclination relative to a horizontal plane.

The posture information obtaining device 33 obtains posture information regarding the attitude of the construction machine. The posture information obtaining device 33 is, for example, a sensor for obtaining the posture information of the excavation attachment of the shovel 50. According to this embodiment, the sensor for obtaining the posture information includes a boom angle sensor 33*a* (see FIG. 1)

to detect the inclination of the boom 4 relative to the upper turning body 3, an arm angle sensor 33*b* (see FIG. 1) to detect the inclination of the arm 5 relative to the boom 4, and a bucket angle sensor 33*c* (see FIG. 1) to detect the inclination of the bucket 6 relative to the arm 5. The posture information includes the position of the leading edge of the bucket 6, the turning radius of the excavation attachment, etc. The posture information obtaining device 33 outputs the obtained posture information to the control device 30. The boom angle sensor 33*a*, the arm angle sensor 33*b*, and the bucket angle sensor 33*c* may be acceleration sensors, gyro sensors, potentiometers using a variable resistor, stroke sensors to detect the stroke amount of a corresponding hydraulic cylinder, or rotary encoders to detect a rotation angle about a link pin. According to this embodiment, each of the boom angle sensor 33*a*, the arm angle sensor 33*b*, and the bucket angle sensor 33*c* is formed of a combination of an acceleration sensor and a gyro sensor.

The operating condition information obtaining device 34 obtains operating condition information. The "operating condition information" is information on the operation of the construction machine, and includes, for example, hydraulic information regarding the condition of the hydraulic system of the construction machine, engine information regarding the condition of the engine of the construction machine, abnormality information regarding abnormalities in the construction machine, etc.

The hydraulic information includes, for example, the discharge pressure of a hydraulic pump (not depicted), the discharge flow rate of the hydraulic pump, a command to a control valve (not depicted) that controls the flow of hydraulic oil between the hydraulic pump and hydraulic actuators such as the boom cylinder 7, the arm cylinder 8, and the bucket cylinder 9 (for example, the amount of lever operation), the pressure of hydraulic oil in hydraulic actuators, etc. The engine information includes, for example, the temperature of a radiator coolant, the boost pressure of a forced-induction device attached to the engine, the output torque, the engine rotational speed, the amount of fuel injection (the amount of fuel consumption), the amount of air intake, etc. The abnormality information includes, for example, an abnormality in the engine electrical system, an abnormality in battery charging, an abnormality in a coolant, an abnormality in the engine oil pressure, engine overheating, etc.

According to this embodiment, the operating condition information obtaining device 34 includes a pressure sensor 34*a* (see FIG. 1) to detect the discharge pressure of the hydraulic pump, an engine rotational speed sensor 34*b* (see FIG. 1) to detect the rotational speed of the engine, and a fuel injection amount sensor 34*c* (see FIG. 1) to detect the amount of fuel injection.

The storage device 35 is a device for storing various kinds of information. The storage device 35 is, for example, a nonvolatile storage medium such as a flash memory, and is desirably detachable and reattachable through a dedicated insertion slot in the cabin 10.

The communications device 36 is a device to control communications between the construction machine and the outside. The communications device 36, for example, performs transmission and reception of information between the shovel 50 and the server 22 at a remote location through satellite communications. Specifically, the communications device 36 transmits information stored in the storage device 35 to the server 22 through the base station 21. The communications device 36 may achieve the exchange of information between the shovel 50 and the base station 21 through a mobile phone network, a short-range wireless communications network, or the like.

The communications device 36 transmits the body position information, orientation information, posture information, operating condition information, calculated condition information, work mode information, work type information, and soil amount information stored in the RAM of the control device 30 to the server 22 according to a command from the control device 30.

The display device 37 displays various kinds of information. According to this embodiment, the display device 37 is a liquid crystal display installed in the cabin 10.

The work mode information obtaining device 38 obtains work mode information indicating the work mode of the construction machine. The work mode is a mode that determines the output characteristic of the construction machine. Specifically, the work mode is the operating mode of the shovel 50 prepared in accordance with a work load, and corresponds to the set rotational speed of the engine. The operator operates a mode switching mechanism (not depicted) provided in the cabin 10 to set the work mode. Once the work mode is set by the operator, the engine rotational speed is controlled to be equal to the set rotational speed corresponding to the set work mode. The work mode information obtaining device 38 is, for example, a sensor for detecting an operation on the mode switching mechanism provided in the cabin 10. According to this embodiment, the work mode includes A mode corresponding a low work load, H mode corresponding to a moderate work load, and SP mode corresponding to a high work load. For example, a set rotational speed corresponding to A mode is 1500 rpm, a set rotational speed corresponding to H mode is 1700 rpm, and a set rotational speed corresponding to SP mode is 1800 rpm. The work mode information obtaining device 38 outputs the obtained work mode information to the control device 30. The work mode may be not only set with the mode switching mechanism but also set by the operator's voice when the control device 30 has a voice recognition function. Furthermore, the output characteristic of the hydraulic pump may be changed in response to a change in the setting of the work mode. Thus, by changing the output characteristic of the engine or the output characteristic of the hydraulic pump, the output characteristic of the hydraulic circuit can be changed.

Next, functional elements of the control device 30 are described.

The condition calculating part 300 calculates various kinds of information based on the body position information, orientation information, posture information, the operating condition information, etc., stored in the RAM of the control device 30. The various kinds of information include load factor information and fuel consumption information. The load factor information includes the load factor of the engine, and the fuel consumption information includes instantaneous fuel consumption that is the amount of fuel injection per unit time, average fuel consumption that is the average of instantaneous fuel consumptions during a predetermined period, the subtotal of the amount of fuel injection during a target period, etc. The condition calculating part 300 can calculate the load factor of the engine based on the engine rotational speed and the amount of air intake included in the engine information, for example. The condition calculating part 300 can calculate the instantaneous fuel consumption, the average fuel consumption, etc., based on the amount of fuel injection included in the engine information, for example. The condition calculating part 300 stores the calculated various kinds of information in the RAM.

The work type estimating part 301 estimates the type of the shovel 50's work based on the body position information, orientation information, posture information, operating condition information, etc., stored in the RAM of the control device 30. Examples of work types include idling, traveling, excavation, ground leveling, crane work, lifting magnet work, etc. The work type estimating part 301 can estimate work types such as idling and traveling based on the engine information included in the operating condition information, for example. The work type estimating part 301 can estimate work types such as traveling based on the body position information. The work type estimating part 301 can calculate the trajectory of the bucket 6 based on the orientation information and the posture information and estimate work types such as excavation and ground leveling based on the obtained trajectory. The work type estimating part 301 can estimate work types such as excavation and ground leveling based on the hydraulic information (a pilot pressure, etc.) included in the operating condition information. When the operator selects a work type with a setting switch in the cabin 10, the work type estimating part 301 may obtain the work type selected with the setting switch as an estimation result. The work type estimating part 301 stores work type information indicating the estimated work type in the RAM.

The workload estimating part 302 estimates the amount of soil excavated by the shovel 50, serving as a workload, based on the body position information, orientation information, posture information, operating condition information, etc., stored in the storage device 35. The workload estimating part 302 can detect the starting point of excavation based on the hydraulic information (a cylinder pressure, etc.) included in the operating condition information, calculate the trajectory of the bucket 6 from the starting point based on the orientation information and the posture information, and estimate the amount of soil based on the obtained trajectory, for example. The workload estimating part 302 may estimate the amount of soil using the result of estimation by the work type estimating part 301. Specifically, it is possible to estimate the amount of soil based on the body position information, orientation information, posture information, and operating condition information during a period in which the work type is estimated as excavation by the work type estimating part 301. The workload estimating part 302 stores soil amount information indicating the estimated amount of soil in the RAM. The workload estimating part 302 may estimate the amount of soil by detecting a difference in terrain between before and after excavation using a camera, a laser, a Lidar or the like. The workload estimating part 302 may estimate the weight of soil (weight) instead of the amount of soil (volume) as workload. This is because the load capacity of a dump truck onto which soil is loaded is restricted by weight. Furthermore, when the end attachment is a lifting magnet, the workload estimating part 302 may estimate the weight of a suspended load (weight) as workload. The weight of soil and the weight of a suspended load are estimated based on at least one of a boom cylinder pressure, a posture sensor, and an arm cylinder pressure.

Figure 4:
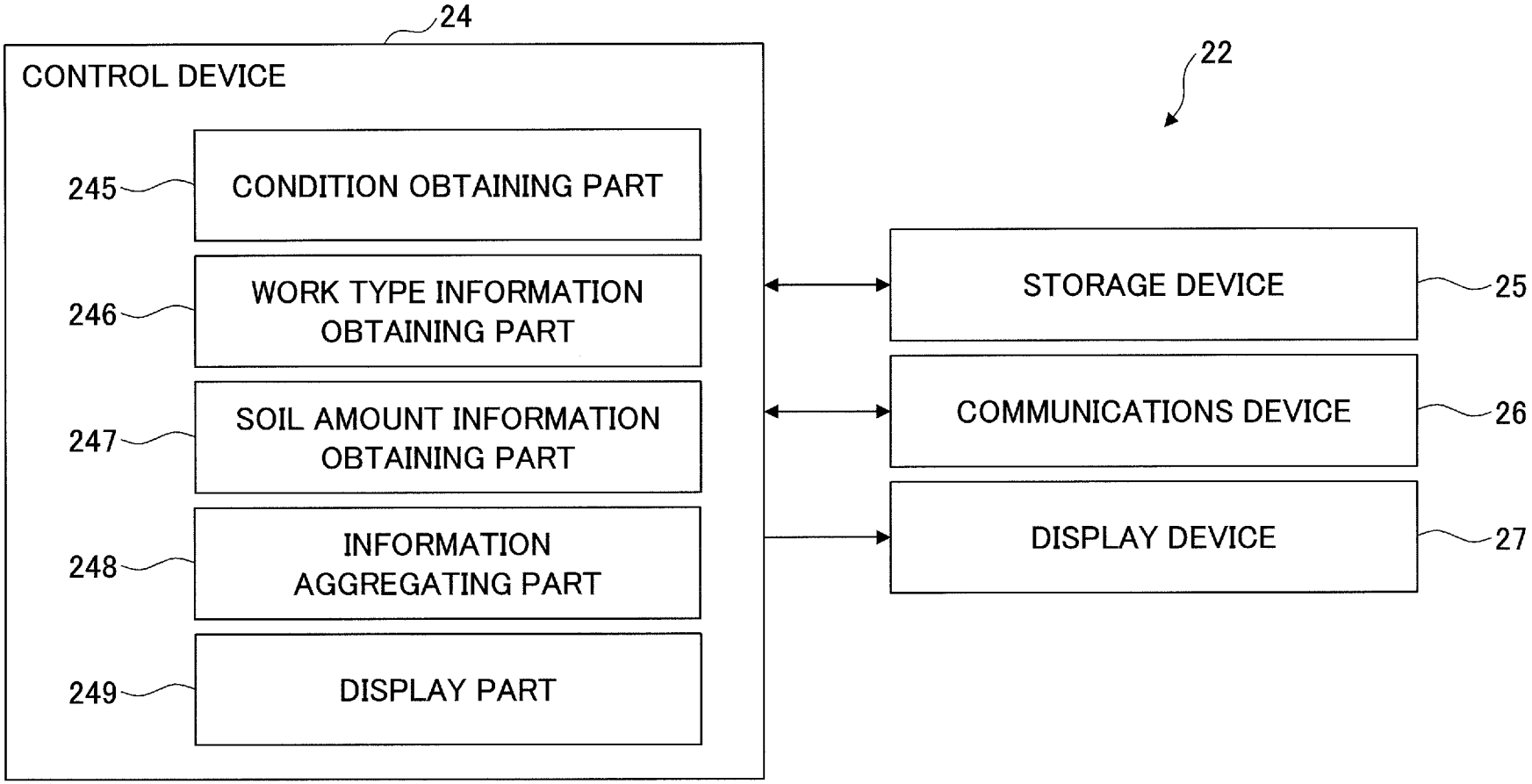
FIG. 4 is a schematic diagram illustrating an example configuration of a server.

FIG. 4 is a schematic diagram illustrating an example configuration of the server 22 according to the embodiment of the present invention. The server 22 is composed mainly of a control device 24, a storage device 25, a communications device 26, and a display device 27.

The control device 24 is a device to control the operation of the server 22, and is, for example, a computer including a CPU, a RAM, a ROM, etc. Specifically, the control device 24 reads programs corresponding to the functional elements of a condition obtaining part 245, a work type information obtaining part 246, a soil amount information obtaining part 247, an information aggregating part 248, and a display part 249 from the ROM, loads the programs into the RAM, and causes the CPU to execute processes corresponding to the functional elements.

The storage device 25 is a device for storing various kinds of information. The storage device 25 is, for example, a nonvolatile storage medium such as an HDD.

The communications device 26 is a device to control communications between the server 22 and the outside. The communications device 26, for example, performs transmission and reception of information between the server 22 and the shovel 50 at a remote location through satellite communications. Specifically, the communications device 26 receives information transmitted by the shovel 50 through the base station 21. The communications device 26 may achieve the exchange of information between the server 22 and the base station 21 through a mobile phone network, a short-range wireless communications network, or the like.

The display device 27 is a device to display various kinds of information. According to this embodiment, the display device 27 is a liquid crystal display installed in a management facility of the shovel 50.

Next, various functional elements of the control device 24 are described.

The condition obtaining part 245 obtains the body position information, orientation information, posture information, operating condition information, work mode information, load factor information, fuel consumption information, etc., transmitted by the shovel 50 through the communications device 26, and stores the information in the storage device 25 as history information. When the load factor of the engine is not included in the information transmitted by the shovel 50, the condition obtaining part 245 may calculate the load factor based on the output torque, the engine rotational speed, etc. Likewise, when the fuel consumption information is not included in the information transmitted by the shovel 50, the condition obtaining part 245 may calculate the fuel consumption information based on the amount of fuel injection, etc.

The work type information obtaining part 246 obtains the work type information transmitted by the shovel 50 through the communications device 26, and stores the information in the storage device 25 as history information.

The soil amount information obtaining part 247 obtains the soil amount information transmitted by the shovel 50 through the communications device 26, and stores the information in the storage device 25 as history information.

The information aggregating part 248 aggregates the fuel consumption information stored in the storage device 25 by work mode. The information aggregating part 248 may aggregate the history information by work mode and by load factor. The information aggregating part 248 may aggregate the history information by work mode and by work type. In any case, the fuel consumption information is aggregated by work mode. The information aggregating part 248 may aggregate the fuel consumption information at predetermined time intervals, at a predetermined time, or at a predetermined timing (for example, at the operator (manager)'s request). The range (aggregation period) of the fuel consumption information aggregated by the information aggregating part 248 may be set as desired. The information aggregating part 248 stores the aggregate results in the storage device 25.

The display part 249 displays the various kinds of history information stored in the storage device 25 and the aggregate results generated by the information aggregating part 248 on the display device 27 in response to the operator (manager)'s request.

Figure 5:
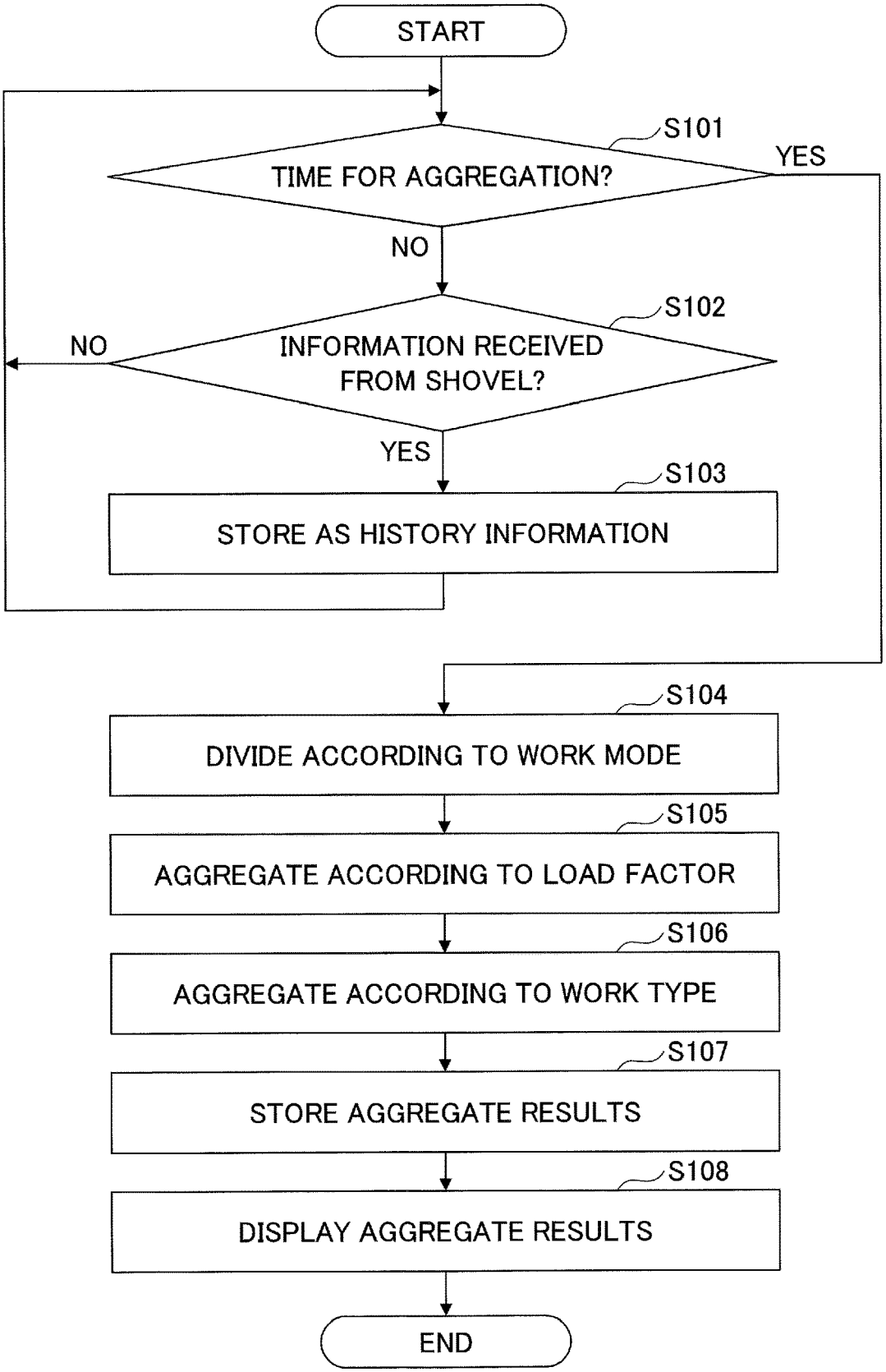
FIG. 5 is a flowchart illustrating a process of the server.

Next, a process of the server 22 according to the embodiment of the present invention is described with reference to FIG. 5. FIG. 5 is a flowchart illustrating an example of the process of the server 22.

The information aggregating part 248 periodically determines whether it is time for aggregation (step S101). If it is not time for aggregation (NO at step S101), the information aggregating part 248 waits until the next determination time. If the server 22 receives information from the shovel 50 during this wait period (YES at step S102), the control device 24 stores the received information in the storage device 25 as history information.

Specifically, when the server 22 receives the body position information, orientation information, posture information, operating condition information, work mode information, load factor information, fuel consumption information, work type information, soil amount information, etc., the control device 24 stores the received information in the storage device 25 as history information.

The control device 24 repeatedly executes the process of steps S101 through S103 until the time for aggregation comes. As a result, the body position information, orientation information, posture information, operating condition information, work mode information, load factor information, fuel consumption information, work type information, and soil amount information are stored in the storage device 25 as history information.

FIG. 6 is a diagram illustrating an example of the history information stored in the storage device 25. According to the illustration of FIG. 6, the body position information, orientation information, posture information, operating condition information, work mode information, load factor information, fuel consumption information, work type information, and soil amount information of each second are included as the history information. The body position information is the latitude and longitude of the shovel 50. The orientation information is the azimuth angle of the shovel 50. In FIG. 6, the time is the obtaining time of information. The posture information is an angle representing the attitude of the shovel 50. The operating condition information is the amount of fuel injection per second, and the load factor information is the load factor of the engine. For example, at the obtaining time of 10:00:00, the body position is 36° 00' 00" N and 140° 00' 00" E, the attitude is 40°, the amount of fuel injection is 0.3 mL, the load factor is 30%, the work mode is H mode, the work type is excavation, and the amount of soil is 0 $m^3$. Until the time for aggregation comes, such history information as FIG. 6 is accumulated in the storage device 25. The time intervals at which each information item is obtained are not limited to one second. The time intervals at which each information item is obtained may differ between information items.

When the time for aggregation comes (YES at step S101), the information aggregating part 248 divides the history information stored in the storage device 25 according to the work type (step S104). As a result, the various kinds of information (such as the fuel consumption information) are divided according to the work type.

Next, the information aggregating part 248 aggregates the various kinds of information (such as the fuel consumption information) divided according to the work mode with respect to each load factor (step S105). Specifically, the information aggregating part 248 divides the history information divided according to the work mode according to the load factor range (for example, in units of 10%), and aggregates the fuel consumption information included in the divided history information. As a result, the fuel consumption information is aggregated by work mode and by load factor. The information aggregating part 248 may aggregate the period (cumulative time) of the history information by work mode and by load factor. The information aggregating part 248 may aggregate the soil amount information by work mode, or by work mode and by load factor.

Next, the information aggregating part 248 aggregates the various kinds of information (such as the fuel consumption information) divided according to the work mode with respect to each work type (step S106). Specifically, the information aggregating part 248 divides the history information divided according to the work mode according to the work type, and aggregates the fuel consumption information included in the divided history information. As a result, the fuel consumption information is aggregated by work mode and by work type. The information aggregating part 248 may aggregate the period (cumulative time) of the history information by work mode and by work type. The information aggregating part 248 may aggregate the soil amount information by work mode, or by work mode and by work type.

Thereafter, the information aggregating part 248 stores the aggregate results obtained at steps S105 and S106 in the storage device 25 (step S107). After storing the aggregate results, in response to the operator (manager)'s request to display the aggregation results, the display part 249 displays the aggregate results stored in the storage device 25 in a predetermined format on the display device 27.

FIG. 7 is a diagram illustrating an example of the aggregate results displayed on the display device 27. The aggregate results of FIG. 7 are the results of aggregation by work mode and by load factor, and the aggregation period is a period during which the shovel was in operation on Jul. 20, 2016. According to the illustration of FIG. 7, the fuel consumption information is the subtotal of the amount of fuel injection during an associated period, the load factor range is one of "25% or less," "50% or less," "75% or less," and "100% or less," and the amount of soil is aggregated by work mode, where "25% or less" corresponds to the range of more than or equal to 0% and less than or equal to 25%, "50% or less" corresponds to the range of more than 25% and less than or equal to 50%, "75% or less" corresponds to the range of more than 50% and less than or equal to 75%, and "100% or less" corresponds to the range of more than 75% and less than or equal to 100%. For example, according to FIG. 7, on Jul. 20, 2016, the cumulative time of use of A mode is 2 hours, during which the engine load factor is 25% or less cumulatively for 0.3 hours, and the subtotal of the amount of fuel injection during a period in which the load factor is 25% or less is 1.2 L.

FIG. 8 is a diagram illustrating an example of the aggregate results displayed on the display device 27. The aggregate results of FIG. 8 are the results of aggregation by work mode and by work type, and the aggregation period is a period during which the shovel was in operation on Jul. 20, 2016. According to the illustration of FIG. 8, the fuel consumption information is the subtotal of the amount of fuel injection during an associated period, the work type is, for example, one of "idling," "traveling," "excavation," and "ground leveling," and the amount of soil is aggregated by work mode. For example, according to FIG. 8, on Jul. 20, 2016, the cumulative time of use of A mode is 3.6 hours, during which the cumulative time of excavation work by the shovel 50 is 0.7 hours, and the subtotal of the amount of fuel injection during the excavation work is 3.5 L.

Thus, according to the embodiment of the present invention, the fuel consumption information aggregated by work mode can be displayed on the display device 27. By looking at the aggregate results displayed on the display device 27, the operator (manager) can accurately understand the fuel consumption information of the shovel 50 work mode by work mode, that is, engine rotational speed by engine rotational speed.

According to the embodiment of the present invention, the fuel consumption information can be aggregated by load factor or by work type, and the aggregate results can be displayed on the display device 27. By looking at the aggregate results displayed on the display device 27, the operator (manager) can easily recognize the mismatch of the work mode.

The mismatch of the work mode refers to a mismatch between the work load of work and a work load corresponding to a work mode set during the performance of the work. The cases where the mismatch of the work mode occurs include the case where a work mode corresponding to a low work load is set during the performance of work of a high work load and the case where a work mode corresponding to a high work load is set during the performance of work of a low work load.

The occurrence of the mismatch of the work mode reduces the fuel efficiency of the shovel 50. Therefore, it is important for the operator (manager) to recognize the mismatch of the work mode. By recognizing the mismatch of the work mode, the operator can select an appropriate work mode. As a result the fuel efficiency of the shovel 50 can be improved. By recognizing the mismatch of the work mode, the manager can propose a method of selecting a more appropriate work mode to the operator.

Here, specific examples of the mismatch of the work mode are described. FIGS. 9 through 11 are diagrams illustrating examples of the aggregate results displayed on the display device 27.

According to the illustration of FIG. 9, the cumulative time is large for A mode and "100% or less." The work performed in A mode and at "100% or less" is believed to be work of a work load higher than a work load to which A mode corresponds. That is, the large cumulative time for A mode and "100% or less" means a long period of work with the occurrence of the mismatch of the work mode. By looking at the aggregate results of FIG. 9, the operator (manager) can easily recognize such a mismatch of the work mode. As a result, the operator can understand that it is appropriate to select a work mode higher in corresponding work load than A mode (for example, H mode) in the case of performing similar work. Therefore, it is possible to improve the fuel efficiency of the shovel 50 afterwards. The manager can make a proposal to the operator that the operator select a work mode higher in corresponding work load than A mode (for example, H mode) in the case of performing similar work.

The information aggregating part 248 may automatically detect the mismatch of the work mode based on a preset detection condition. For example, as a detection condition, it is possible to set a threshold for the cumulative time of the occurrence of the mismatch of the work mode. In this case, the information aggregating part 248 may specify, as a recommended work mode, a work mode that should have been selected. The effect that would have been achieved if the recommended work mode had been selected may be calculated. Examples of the effect that would have been achieved if the recommended work mode had been selected include the amount of fuel injection, the cumulative time, etc., that would have been saved if the recommended work mode had been selected.

When the information aggregating part 248 automatically detects the mismatch of the work mode, the display part 249 preferably displays the aggregate results such that the detected mismatch can be recognized. Specifically, it is possible to display the details of the detected mismatch in text or display a portion of the aggregate results corresponding to the mismatch (for example, the field of the cumulative time of A mode and "100% or less" in FIG. 9) in a color different from that of the other portion. The display part 249 may display a proposal according to the detected mismatch in text along with the aggregate results. The control device 24 may notify the operator (manager) of the detected mismatch or a proposal according to the mismatch by e-mail or the like.

Specifically, as illustrated in FIG. 9, the display part 249 may highlight and display the cumulative time in A mode and "100% or less." The display part 249 may also display a message to the effect that H mode is a recommended work mode, and may also display the amount of fuel injection that would have been saved if the recommended work mode had been selected (the supposed amount of fuel consumption) as the effect that would have been achieved if the recommended work mode had been selected.

According to the illustration of FIG. 10, the cumulative time is large for SP mode and "25% or less." The work performed in SP mode and at "25% or less" is believed to be work of a work load lower than a work load to which SP mode corresponds. That is, the large cumulative time for SP mode and "25% or less" means a long period of work with the occurrence of the mismatch of the work mode. By looking at the aggregate results of FIG. 10, the operator (manager) can easily recognize such a mismatch of the work mode. As a result, the operator can understand that it is appropriate to select a work mode lower in corresponding work load than SP mode (for example, H mode) in the case of performing similar work. Therefore, it is possible to improve the fuel efficiency of the shovel 50 afterwards. The manager can make a proposal to the operator that the operator select a work mode lower in corresponding work load than A mode (for example, H mode) in the case of performing similar work. In this case, as illustrated in FIG. 10, the display part 249 may highlight and display the cumulative time in SP mode and "25% or less." The display part 249 may also display a message to the effect that H mode is a recommended work mode, and may also display the amount of fuel injection that would have been saved if the recommended work mode had been selected (the supposed amount of fuel consumption) as the effect that would have been achieved if the recommended work mode had been selected.

According to the illustration of FIG. 11, the cumulative time is large for SP mode and "ground leveling." When "ground leveling" is work of a work load lower than a work load to which SP mode corresponds, the large cumulative time for SP mode and "ground leveling" means a long period of work with the occurrence of the mismatch of the work mode. By looking at the aggregate results of FIG. 11, the operator (manager) can easily recognize such a mismatch of the work mode. As a result, in the case of performing ground leveling, the operator tries to select a work mode lower in corresponding work load that SP mode (for example, H mode), so that it is possible to improve the fuel efficiency of the shovel 50 afterwards. The manager can make a proposal to the operator that the operator select a work mode lower in corresponding work load than SP mode (for example, H mode) in the case of performing similar work. In this case, as illustrated in FIG. 11, the display part 249 may highlight and display the cumulative time in SP mode and "ground leveling." The display part 249 may also display a message to the effect that H mode is a recommended work mode, and may also display the effect that would have been achieved if the recommended work mode had been selected. The same applies to the case where the cumulative time is large for SP mode and "idling."

As described above, the server 22 displays each range of the load factor in each work mode or the cumulative time, the fuel consumption information, etc., with respect to each work type. Therefore, the operator (manager) can identify inefficient work or can identify a work mode that should have been selected. As a result, it is possible to achieve energy saving in work that uses the shovel 50.

An embodiment of the present invention is described above. The present invention, however, is not limited to the above-described embodiment. Various variations, substitutions, etc., may apply to the above-described embodiment without departing from the scope of the present invention. Furthermore, the technical features described with reference to the above-described embodiment may be suitably combined as long as causing no technical contradiction.

For example, while the above-described embodiment illustrates the case where the present invention is applied to the shovel 50, the present invention is not limited to this. The present invention may also apply to, for example, other construction machines with a lifting magnet, a grapple, a crusher, or the like.

Steps S105 and S106 of FIG. 5 may be in reverse order, and one of steps S105 and S106 may not be executed.

The control device 24 of the server 22 may include functional elements equivalent to the condition calculating part 300, the work type estimating part 301, and the workload estimating part 302. In this case, the condition calculating part, the work type estimating part, and the workload estimating part of the control device 24 may calculate various kinds of information and estimate the work type and the amount of soil based on information received from the shovel 50, and store the load factor information, fuel consumption information, work type information, and soil amount information in the storage device 25 as history information.

The control device 24, after aggregating history information through the information aggregating part 248, may delete at least part of information other than the aggregate results stored in the storage device 25. This makes it possible to reduce storage capacity required of the storage device 25.

The shovel 50 may include a functional element equivalent to the display part 249. In this case, the server 22 may transmit the aggregate results by the information aggregating part 248 to the shovel 50, and the display part of the shovel 50 may display the aggregate results received from the server 22 on the display device 37. Furthermore, the shovel 50 may include one or more of the other functional elements of the server 22 than the display part 249. For example, the control device 30 may include functional elements corresponding to the condition obtaining part 245, the work type information obtaining part 246, the soil amount information obtaining part 247, and the information aggregating part 248.

Figure 12:
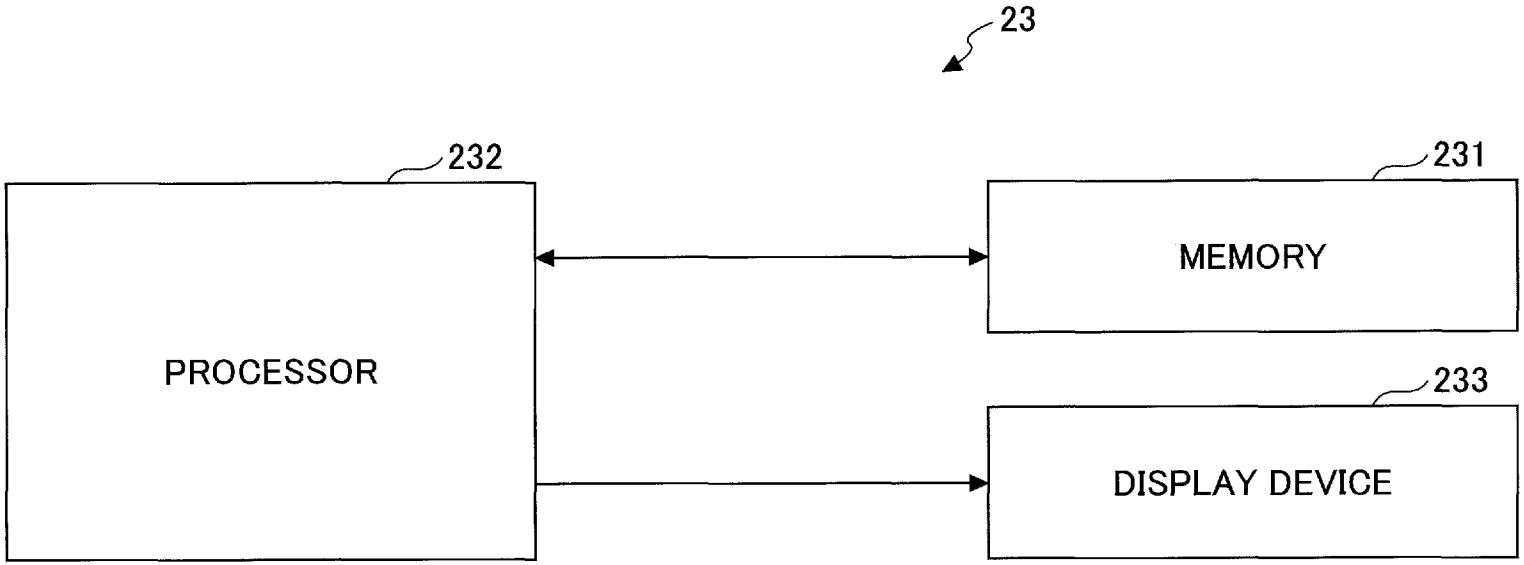
FIG. 12 is a block diagram illustrating an example configuration of a communications terminal.

Likewise, the communications terminal 23 may include a functional element equivalent to the display part 249. In this case, the server 22 may transmit the aggregate results by the information aggregating part 248 to the communications terminal 23, and the display part of the communications terminal 23 may display the aggregate results received from the server 22 on a display device. For example, referring to FIG. 12, the communications terminal 23 includes a memory (storage device) 231 including a ROM and a RAM, a processor 232 such as a CPU coupled to the memory 231, and a display device 233 connected to the processor 232. The processor 232 may execute the function of the display part 249 to display the aggregate results received from the server 22 on the display device 233.

What is claimed is:

1. A shovel management apparatus configured to manage a shovel including a lower traveling body, an upper turning body mounted on the lower traveling body via a turning mechanism, and an excavation attachment attached to the upper turning body, the shovel management apparatus comprising:

a communications device configured to receive information from the shovel;

a memory; and a processor coupled to the memory, and configured to:

obtain load factor information of the shovel, fuel consumption information regarding fuel consumption of the shovel, work mode information indicating a set work mode of the shovel, and work type information indicating a type of work of the shovel, from the information received from the shovel; and aggregate the fuel consumption information according to the work mode and the load factor information or according to the work mode and the work type information.

2. The shovel management apparatus as claimed in claim 1, wherein the processor is configured to aggregate the fuel consumption information according to the load factor information, the load factor information being a load factor of an engine of the shovel.

3. The shovel management apparatus as claimed in claim 1, wherein the processor is configured to aggregate the fuel consumption information according to the work type information.

4. The shovel management apparatus as claimed in claim 1, wherein the processor is configured to obtain at least one of hydraulic information regarding a condition of a hydraulic system and engine information regarding a condition of an engine of the shovel, from the information received from the shovel.

5. The shovel management apparatus as claimed in claim 1, wherein the processor is further configured to estimate the type of work of the shovel from the information received from the shovel.

6. The shovel management apparatus as claimed in claim 1, wherein the processor is configured to aggregate a workload of the shovel according to the work mode.

7. The shovel management apparatus as claimed in claim 1, further comprising:

a display, wherein the processor is further configured to display a result of aggregating the fuel consumption information on the display.

8. The shovel management apparatus as claimed in claim 7, wherein the processor is configured to detect a mismatch of the work mode and identify a recommended work mode that should have been selected; and display the recommended work mode on the display.

9. The shovel management apparatus as claimed in claim 7, wherein the processor is configured to identify a recommended work mode that should have been selected and calculate an amount of fuel consumption that would have been saved if the recommended work mode had been selected; and display the amount of fuel consumption that would have been saved if the recommended work mode had been selected on the display.

10. The shovel management apparatus as claimed in claim 1, wherein the processor is configured to aggregate a cumulative time according to the work mode.

11. The shovel management apparatus as claimed in claim 1, wherein the processor is configured to aggregate the fuel consumption information according to a load of work performed by the shovel and the work mode.

12. A shovel comprising:

a lower traveling body;

an upper turning body mounted on the lower traveling body via a turning mechanism; and an excavation attachment attached to the upper turning body;

a memory; and a processor coupled to the memory, and configured to calculate load factor information of the shovel and fuel consumption information regarding fuel consumption of the shovel based on information stored in the memory, obtain work mode information indicating a set work mode of the shovel, and estimate work type information indicating a type of work of the shovel based on the information stored in the memory; and aggregate the fuel consumption information according to the work mode and the load factor information or according to the work mode and, the work type information.

13. The shovel as claimed in claim 12, wherein the processor is configured to aggregate the fuel consumption information according to a load of work performed by the shovel and the work mode.

14. A shovel management assisting device that assists management of a shovel including a lower traveling body, an upper turning body mounted on the lower traveling body via a turning mechanism, and an excavation attachment attached to the upper turning body, the shovel management assisting device being configured to communicate with an external apparatus, the shovel management assisting device comprising:

a display;

a memory; and a processor coupled to the memory, and configured to display an aggregate result of aggregating fuel consumption information regarding fuel consumption of the shovel according to a set work mode of the shovel and load factor information of the shovel or according to the set work mode of the shovel and work type information indicating a type of work of the shovel, on the display, the aggregate result being received from the external apparatus by the shovel management assisting device.

15. The shovel management assisting device as claimed in claim 14, wherein the processor is configured to display the received aggregate result of aggregating fuel consumption information according to a load of work performed by the shovel and the work mode, on the display.

* * * * *